US009695379B2

(12) United States Patent
Sakanoue et al.

(10) Patent No.: US 9,695,379 B2
(45) Date of Patent: Jul. 4, 2017

(54) LUBRICATING OIL COMPOSITION FOR SHOCK ABSORBER AND FRICTION REDUCTION METHOD FOR SHOCK ABSORBER

(71) Applicant: IDEMITSU KOSAN CO., LTD., Chiyoda-ku (JP)

(72) Inventors: Shuichi Sakanoue, Chiba (JP); Aya Aoki, Sodegaura (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 14/911,112

(22) PCT Filed: Aug. 25, 2014

(86) PCT No.: PCT/JP2014/072118
§ 371 (c)(1),
(2) Date: Feb. 9, 2016

(87) PCT Pub. No.: WO2015/025972
PCT Pub. Date: Feb. 26, 2015

(65) Prior Publication Data

US 2016/0194576 A1 Jul. 7, 2016

(30) Foreign Application Priority Data

Aug. 23, 2013 (JP) ..... 2013-173919

(51) Int. Cl.
*C10M 137/10* (2006.01)
*C10M 169/06* (2006.01)
(Continued)

(52) U.S. Cl.
CPC ..... *C10M 169/04* (2013.01); *C10M 101/02* (2013.01); *C10M 129/76* (2013.01);
(Continued)

(58) Field of Classification Search
USPC ..... 508/370, 510, 519
See application file for complete search history.

(56) References Cited

U.S. PATENT DOCUMENTS 5,273,672 A * 12/1993 Dasai ..... C10M 129/00 252/79
6,306,801 B1 * 10/2001 Yagishita ..... C10M 163/00 508/292
2007/0259792 A1 11/2007 Null

FOREIGN PATENT DOCUMENTS

EP 0 719 851 7/1996
EP 2 169 037 A1 3/2010
(Continued)

OTHER PUBLICATIONS

International Search Report issued Nov. 25, 2014 in PCT/JP2014/072118 filed Aug. 25, 2014.
(Continued)

*Primary Examiner* — Vishal Vasisth
(74) *Attorney, Agent, or Firm* — Oblon, McClelland, Maier & Neustadt, L.L.P.

(57) ABSTRACT

Provided is a lubricating oil composition for a shock absorber excellent in thermal stability and capable of reducing the friction factor for rubber. The lubricating oil composition for a shock absorber contains (A) a base oil composed of a mineral oil and/or a synthetic oil, (B) a zinc dithiophosphate represented by the following general formula (I), (C) a fatty acid amide and (D) a polyalcohol ester.

(I)

(Continued)

In the formula, $R^1$ to $R^4$ each independently represent at least one selected from a linear, branched or cyclic alkyl group having from 6 to 20 carbon atoms and a linear, branched or cyclic alkenyl group having from 6 to 20 carbon atoms.

13 Claims, 1 Drawing Sheet

(51) Int. Cl.

| | |
|---|---|
| ***C10M 133/16*** | (2006.01) |
| ***C10M 169/04*** | (2006.01) |
| ***C10M 141/10*** | (2006.01) |
| ***C10M 101/02*** | (2006.01) |
| ***C10M 129/76*** | (2006.01) |

(52) U.S. Cl.

CPC ..... *C10M 133/16* (2013.01); *C10M 137/10* (2013.01); *C10M 141/10* (2013.01); *C10M 2203/1006* (2013.01); *C10M 2207/283* (2013.01); *C10M 2207/289* (2013.01); *C10M 2209/084* (2013.01); *C10M 2215/082* (2013.01); *C10M 2223/045* (2013.01); *C10M 2229/051* (2013.01); *C10N 2210/02* (2013.01); *C10N 2230/02* (2013.01); *C10N 2230/06* (2013.01); *C10N 2230/08* (2013.01); *C10N 2230/10* (2013.01); *C10N 2240/08* (2013.01)

(56) References Cited

FOREIGN PATENT DOCUMENTS

| | | | |
|---|---|---|---|
| JP | 5-255682 | A | 10/1993 |
| JP | 5-255683 | A | 10/1993 |
| JP | 9-111277 | A | 4/1997 |
| JP | 2008-163165 | A | 7/2008 |
| JP | 2008-163166 | A | 7/2008 |
| JP | 2009-13380 | A | 1/2009 |
| JP | 2009-530460 | A | 8/2009 |

OTHER PUBLICATIONS

Extended European Search Report issued Jan. 4, 2017, in European Patent Application No. 14837233.7.

* cited by examiner

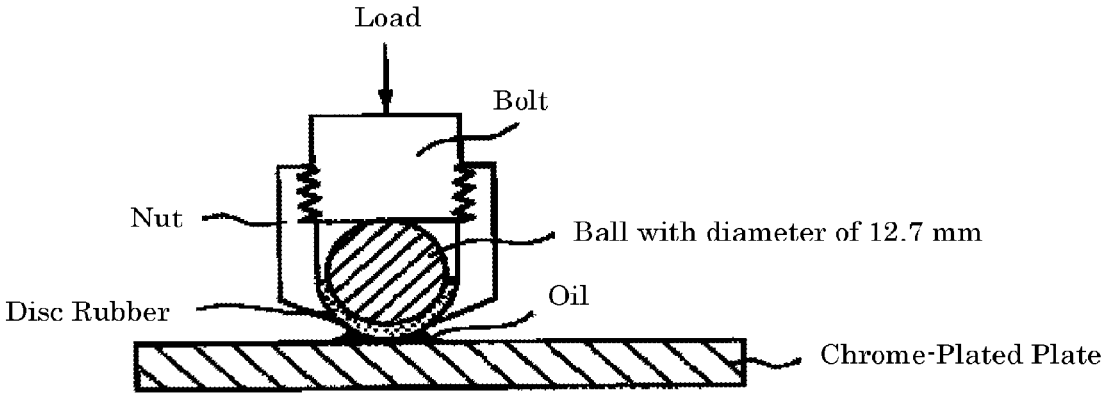
Load
Bolt
Nut
Ball with diameter of 12.7 mm
Disc Rubber
Oil
Chrome-Plated Plate

LUBRICATING OIL COMPOSITION FOR SHOCK ABSORBER AND FRICTION REDUCTION METHOD FOR SHOCK ABSORBER

CROSS-REFERENCE TO RELATED APPLICATIONS

This application is a National Stage of PCT/JP2014/072118, which was filed on Aug. 25, 2014. This application is based upon and claims the benefit of priority to Japanese Application No. 2013-173919, which was filed on Aug. 23, 2013.

TECHNICAL FIELD

The present invention relates to a lubricating oil composition for a shock absorber, and a friction reduction method for a shock absorber. More precisely, the present invention relates to a lubricating oil composition suitable for a shock absorber that constitutes the suspension of an automobile body.

BACKGROUND ART

In a body of automobiles such as motorcycles, cars and the like, used is a suspension integrated with a shock absorber for reducing the vibration of the body caused by road surface roughness, the shaking thereof which occurs in quick acceleration or sudden braking, and the like. The structure of the shock absorber is based on a cylindrical structure that utilizes the resistance of oil to flow. Specifically, as a shock absorber, used is one produced by forming small holes through a hydraulic piston. In accordance with the upward and downward movement of the piston, oil passes through the holes, and the resistance during the movement is proportional to the speed of the piston. In the slide part between the cylinder and the piston rod, placed is a bush that prevents the mutual abration and also acts as a guide, and the part is sealed up with a rubber sealant for preventing oil leakage. Various types of shock absorbers are known, such as double pipe-type ones, gas-filled ones, etc.

Recently, vibration of running automobiles has become suppressed owing to improvement in road conditions, etc., and in many cases, the expansion and contraction movement of shock absorbers has become reduced. When the friction between the rubber sealant and the piston rod is large in such a case where the expansion and contraction movement of a shock absorber is small, the vibration would run through the car to worsen the riding comfort. In particular, in the case of a motorcycle, the vibration transmitted to the handle is felt greatly, thereby often detracting from the riding comfort.

As a lubricating oil composition for a shock absorber, widely used is one containing a zinc dialkyldithiophosphate (PTLs 1 and 2).

However, nothing is discussed in PTLs 1 and 2, relating to the way to reduce the friction between the rubber sealant and the piston rod in the case where the expansion and contraction movement of a shock absorber is small, in which, therefore, the riding comfort could not be improved in the case where the expansion and contraction movement of a shock absorber is small.

For reducing the friction coefficient of a rubber sealant, it is known that a phosphorus-containing additive is effective (PTL 3).

However, the phosphorus-containing additive has a problem in that the thermal stability thereof is poor. In particular, in the case of motorcycles, the shock absorber is not sealed up with nitrogen, and therefore the lubricating oil composition therein is often oxidized at high temperatures, and the importance of thermal stability is great.

PTL 1: JP 2009-13380 A

PTL 2: JP 5-255682 A

PTL 3: JP 5-255683 A

DISCLOSURE OF INVENTION

Technical Problem

Given the situation, the present invention is to provide a lubricating oil composition for a shock absorber, which is excellent in thermal stability and capable of reducing the friction coefficient for rubber, and to provide a friction reduction method for a shock absorber.

Solution to Problem

For solving the above-mentioned problems, the present invention provides a lubricating oil composition for a shock absorber and a friction reduction method for a shock absorber as shown in the following [1] to [3].

[1] A lubricating oil composition for a shock absorber, containing (A) a base oil composed of a mineral oil and/or a synthetic oil, (B) a zinc dithiophosphate represented by the following general formula (I), (C) a fatty acid amide and (D) a polyalcohol ester:

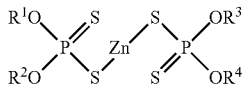

(I)

wherein $R^1$ to $R^4$ each independently represent at least one selected from a linear, branched or cyclic alkyl group having from 6 to 20 carbon atoms and a linear, branched or cyclic alkenyl group having from 6 to 20 carbon atoms.

[2] The lubricating oil composition for a shock absorber according to the above 1, which is for use in motorcycles.

[3] A friction reduction method for a shock absorber, which includes adding the lubricating oil composition for a shock absorber of the above 1, to a shock absorber.

Advantageous Effects of Invention

The lubricating oil composition for a shock absorber of the present invention is excellent in thermal stability and can be prevented from being oxidized and degraded at high temperatures, and in addition, can lower the friction coefficient for rubber, and therefore does not detract from the riding comfort in the case where the expansion and contraction movement of a shock absorber is small. In particular, in the case where the lubricating oil composition of the present invention is used as a lubricating oil composition for a shock absorber for motorcycles, the above-mentioned advantageous effects are more remarkable.

Further, the friction reduction method for a shock absorber of the present invention can effectively reduce the friction of a shock absorber, and in particular, in the case where there exists the friction of a rubber in a shock absorber, the method can exhibit the excellent effect.

BRIEF DESCRIPTION OF DRAWING

FIG. 1 is a view for explaining an evaluation method for the friction coefficient for rubber.

DESCRIPTION OF BEST EMBODIMENTS

Lubricating Oil Composition for Shock Absorber

The lubricating oil composition for a shock absorber of the present invention contains (A) a base oil composed of a mineral oil and/or a synthetic oil, (B) a zinc dithiophosphate represented by the following general formula (I), (C) a fatty acid amide and (D) a polyalcohol ester.

(I)

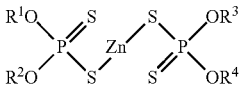

$R^1$ to $R^4$ each independently represent at least one selected from a linear, branched or cyclic alkyl group having from 6 to 20 carbon atoms and a linear, branched or cyclic alkenyl group having from 6 to 20 carbon atoms in the general formula (I).

[(A) Base Oil]

As the base oil in the lubricating oil composition for a shock absorber of the present invention, usable are mineral oil and/or synthetic oil.

Examples of the mineral oil include paraffin-based mineral oil, intermediate-based mineral oil, naphthene-based mineral oil and the like, which are obtained by usual refining processes such as solvent refining, hydrorefining or the like, and those prepared by isomerizing wax produced through Fischer-Tropsch process or the like (gas-to-liquid wax) or mineral oil-based wax, and the like.

Examples of the synthetic oil include hydrocarbon synthetic oil, ether synthetic oil, etc. As examples of the hydrocarbon synthetic oil, there are mentioned α-olefin oligomers such as polybutene, polyisobutylene, 1-octene oligomer, 1-decene oligomer, ethylene-propylene copolymer, etc. and hydrides thereof; alkylbenzene, alkylnaphthalene, etc. Examples of the ether synthetic oil include polyoxyalkylene glycol, polyphenyl ether, etc.

As the base oil, preferred is a mineral oil among the above, from the viewpoint of the solubility of additives therein.

As the base oil, usable is one alone of the above-mentioned mineral oil and/or the above-mentioned synthetic oil, but two or more of those may also be usable. Further, a combination of at least one mineral oil and at least one synthetic oil is also usable.

Regarding the kinematic viscosity of the base oil, the kinematic viscosity thereof at 40° C. is, from the viewpoint of the low-temperature flowability thereof, preferably within a range of from 15 to 40 $mm^2/s$, more preferably from 20 to 30 $mm^2/s$. In the case where two or more of mineral oil and/or synthetic oil are used, the above numerical values mean the kinematic viscosity of the base oil of the mixture thereof.

The content ratio of the base oil of the component (A) in the total amount of the lubricating oil composition for a shock absorber is preferably from 85 to 98% by mass, more preferably from 90 to 94% by mass.

[(B) Zinc Dithiophosphate]

The lubricating oil composition for a shock absorber of the present invention contains, as the component (B), a zinc dithiophosphate of the following general formula (I). The zinc dithiophosphate for use in the present invention reduces the friction coefficient for rubber and is further excellent in thermal stability.

(I)

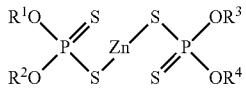

In the formula, $R^1$ to $R^4$ each independently represent at least one selected from a linear, branched or cyclic alkyl group having from 6 to 20 carbon atoms and a linear, branched or cyclic alkenyl group having from 6 to 20 carbon atoms.

In the case where the carbon number of $R^1$ to $R^4$ in the general formula (I) is less than 6, the rubber friction coefficient may increase and the riding comfort may be thereby worsened. On the other hand, in the case where the carbon number of $R^1$ to $R^4$ in the general formula (I) is more than 20, the solubility in the base oil may worsen.

The carbon number of the alkyl group or the alkenyl group of $R^1$ to $R^4$ in the general formula (I) is preferably from 8 to 18, more preferably from 10 to 18, even more preferably from 12 to 18. Also preferably, $R^1$ to $R^4$ in the general formula (I) are an alkyl group.

Examples of the alkyl group of $R^1$ to $R^4$ include a methyl group, an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, an octadecyl group, a nonadecyl group, an eicosyl group, a heneicosyl group, a docosyl group, a tricosyl group and a tetracosyl group, and these may be any of linear, branched or cyclic ones. Examples of the alkenyl group include a vinyl group, a propenyl group, a butenyl group, a pentenyl group, a hexenyl group, a heptenyl group, an octenyl group, a nonenyl group, a decenyl group, an undecenyl group, a dodecenyl group, a tridecenyl group, a tetradecenyl group, a pentadecenyl group, a hexadecenyl group, a heptadecenyl group, an octadecenyl group, a nonadecenyl group, an eicosenyl group, a heneicosenyl group, a docosenyl group, a tricosenyl group and a tetracosenyl group, and these may be any of linear, branched or cyclic ones, and the double bond may be at any position therein.

In the general formula (I), $R^1$ to $R^4$ may be the same as or different from each other, but from the viewpoint of easiness in production, these are preferably the same.

Of those, preferred are a dodecyl group such as a lauryl group, a tetradecyl group, a hexadecyl group, an octadecyl group such as a stearyl group, an eicosyl group, and an octadecenyl group such as an oleyl group.

One or more types of zinc dithiophosphates of the component (B) may be used. Among such zinc dithiophosphates, one in which the carbon number of $R^1$ to $R^4$ is from 8 to 18 is preferably used as the main component, more preferred as the main component is one in which the carbon number is from 10 to 18, even more preferred as the main component is one in which the carbon number is from 12 to 18, and even more preferred as the main component is one in which $R^1$ to $R^4$ are any of a lauryl group or a stearyl group. The wording "as the main component" means that the main component is preferably 50% by mass or more of the total amount of the zinc dithiophosphate of the component (B), more preferably 80% by mass or more, even more preferably 90% by mass or more.

The content of the zinc dithiophosphate of the component (B) is preferably from 0.01 to 3% by mass relative to the total amount of the lubricating oil composition for a shock absorber, more preferably from 0.1 to 1% by mass.

When the content ratio of the zinc dithiophosphate is 0.01% by mass or more, the wear-resistant properties between the piston rod and the bush, between the piston rod and the sealant and between the piston rod and the cylinder of a shock absorber can be readily bettered. On the other hand, when the content ratio of the zinc dithiophosphate is 3% by mass or less, the friction coefficient for rubber can be readily prevented from increasing. Among the piston rod, the sealant and the bush, the sealant and the bush may be formed of rubber. In particular, the sealant is mostly formed of rubber.

The zinc dithiophosphate for use in the present invention can exhibit wear-resistant properties even when the amount thereof used is small, and therefore, the amount thereof may be small relative to the total amount of the lubricating oil composition, and moreover, since it hardly increases the friction coefficient for rubber, it can prevent the risk of detracting from the riding comfort, which is caused by the increase in the friction coefficient for rubber.

[(C) Fatty Acid Amide]

The lubricating oil composition for a shock absorber of the present invention contains a fatty acid amide as the component (C). The fatty acid amide has an effect of reducing the friction coefficient for rubber. The fatty acid amide is an acid amide to be produced by reacting a carboxylic acid and an amine.

As the carboxylic acid, usable is any linear or branched, saturated or unsaturated monocarboxylic acid.

Examples of the monocarboxylic acid include saturated fatty acids (these saturated fatty acids may be linear or branched), such as heptanoic acid, octanoic acid, nonanoic acid, decanoic acid, undecanoic acid, dodecanoic acid, tridecenoic acid, tetradecanoic acid, pentadecanoic acid, hexadecanoic acid, heptadecanoic acid, octadecanoic acid, nonadecanoic acid, eicosanoic acid, heneicosanoic acid, docosanoic acid, tricosanoic acid, tetracosanoic acid, etc.; unsaturated fatty acids (these unsaturated fatty acids may be linear or branched, and the double bond may be at any position therein), such as heptenoic acid, octenoic acid, nonenoic acid, decenoic acid, undecenoic acid, dodecenoic acid, tridecenoic acid, tetradecenoic acid, pentadecenoic acid, hexadecenoic acid, heptadecenoic acid, octadecanoic acid (including oleic acid), nonadecenoic acid, eicosenoic acid, heneicosenoic acid, docosenoic acid, tricosenoic acid, tetracosenoic acid, etc.

Among these monocarboxylic acids, preferred are those having from 8 to 24 carbon atoms and more preferred are those having from 12 to 20 carbon atoms, from the viewpoint of the solubility of the fatty acid amide in the base oil and from the viewpoint of reducing the friction coefficient for rubber. Among these, even more preferred are oleic acid and stearic acid.

In the case where the monocarboxylic acid is used as the starting material for acid amidation with an amine, one alone or two or more types of the acids may be used either singly or as combined.

On the other hand, as the amine, usable are alkylamines, alkanolamines, polyalkylene-polyamines, etc. Among these amines, preferred are alkylamines and polyalkylene-polyamines from the viewpoint of the solubility in the base oil; and among them, even more preferred are polyalkylene-polyamines.

Examples of the alkylamine include primary aliphatic amines (in which the alkyl group may be linear or branched), such as monomethylamine, monoethylamine, monopropylamine, monobutylamine, monopentylamine, monohexylamine, monoheptylamine, etc.; secondary aliphatic alkylamines (in which the alkyl group may be linear or branched), such as dimethylamine, methylethylamine, diethylamine, methylpropylamine, ethylpropylamine, dipropylamine, methylbutylamine, ethylbutylamine, propylbutylamine, dibutylamine, dipentylamine, dihexylamine, diheptylamine, etc.

Examples of the alkanolamine include monomethanolamine, monoethanolamine, monopropanolamine, monobutanolamine, monopentanolamine, monohexanolamine, dimethanolamine, methanolethanolamine, diethanolamine, methanolpropanolamine, ethanolpropanolamine, dipropanolamine, methanolbutanolamine, ethanolbutanolamine, propanolbutanolamine, dibutanolamine, dipentanolamine, dihexanolamine, etc. In these, the alkanol group may be linear or branched.

Examples of the polyalkylene-polyamine include those represented by the following general formula (II):

$$H_2N—(R^5—NH)_m—H \quad (II)$$

(wherein $R^5$ represents an alkylene group having from 2 to 4 carbon atoms, m indicates an integer of from 2 to 6).

Examples of the polyalkylene-polyamine represented by the above general formula (II) include diethylenetriamine, triethylenetetramine, tetraethylenepentamine, pentaethylenehexamine, hexaethyleneheptamine, tetrapropylenepentamine, hexabutyleneheptamine, etc.

The fatty acid amide of the component (C) may be produced, for example, through dehydration of a monocarboxylic acid and an amine in a nitrogen stream atmosphere at a temperature of from 100 to 220° C. or so for from 1 to 40 hours or so.

The content ratio of the fatty acid amide of the component (C) in the total amount of the lubricating oil composition for a shock absorber is preferably from 0.01 to 3% by mass, more preferably from 0.1 to 1% by mass. When the content ratio of the fatty acid amide is 0.01% by mass or more, the friction coefficient for rubber can be readily reduced, and when the content ratio is 3% by mass or less, the stability can be improved.

The ratio by mass of the fatty acid amide of the component (C) to the zinc dithiophosphate of the component (B) ([content of fatty acid amide of component (C)]/[content of zinc dithiophosphate of component (B)]) in the lubricating oil composition for a shock absorber is, from the viewpoint of reducing the friction coefficient for rubber and from the viewpoint of oxidation stability, preferably from 0.1 to 2, more preferably from 0.3 to 0.9.

[(D) Polyalcohol Ester]

The lubricating oil composition for a shock absorber of the present invention contains a polyalcohol ester as the component (D). The polyalcohol ester has an effect of reducing the friction coefficient for rubber. The polyalcohol ester is an ester of a polyalcohol and a monocarboxylic acid, or a complex ester of a polyalcohol and a mixed carboxylic acid of a monocarboxylic acid and a polycarboxylic acid. The polyalcohol ester may be a complete ester or a partial ester, but from the viewpoint of reducing the friction coefficient, preferred is a partial ester.

The polyalcohol to constitute the polyalcohol ester is preferably an aliphatic polyalcohol having from 2 to 15 carbon atoms, specifically including ethylene glycol, propylene glycol, butylene glycol, neopentyl glycol, trimethylolethane, ditrimethylolethane, trimethylolpropane, ditrimethylolpropane, glycerin, pentaerythritol, dipentaerythritol, tripentaerythritol, sorbitol, etc. Among these, preferred are trihydric or more polyhydric aliphatic polyalcohols from the viewpoint of the effect as the oiliness agent; and among these, more preferred is pentaerythritol.

As the carboxylic acid to constitute the polyalcohol ester, preferred is use of a fatty acid having from 3 to 30 carbon atoms. The fatty acid as referred to herein may be linear or branched with no problem, and may contain a saturated or unsaturated alkyl group. The polycarboxylic acid to constitute the complex ester of the polyalcohol ester is preferably an aliphatic dibasic acid or an aromatic dibasic acid, specifically including succinic acid, adipic acid, pimelic acid, azelaic acid, sebacic acid, phthalic acid, isophthalic acid, etc.

Among these carboxylic acids, preferred are fatty acids having from 12 to 24 carbon atoms, and among these, more preferred is oleic acid.

Specific examples of the preferred polyalcohol esters include esters of a trihydric or more polyhydric polyalcohol such as trimethylolpropane, pentaerythritol or the like, and a linear or branched fatty acid having from 12 to 24 carbon atoms or a mixed fatty acid thereof. More specifically, there are mentioned trimethylolpropane monolaurate, trimethylolpropane monostearate, trimethylolpropane monooleate, trimethylolpropane dilaurate, trimethylolpropane distearate, trimethylolpropane dioleates, etc.; pentaerythritol monostearate, pentaerythritol monooleate, pentaerythritol dilaurate, pentaerythritol distearate, pentaerythritol dioleates, dipentaerythritol monooleate, etc.

The polyalcohol ester preferably has, from the viewpoint of reducing the friction coefficient, a molecular weight of from 500 to 800, more preferably from 600 to 700.

The content ratio of the polyalcohol ester of the component (D) in the total amount of the lubricating oil composition for a shock absorber is preferably from 0.01 to 3% by mass, more preferably from 0.1 to 1% by mass. When the content ratio of the polyalcohol ester is 0.01% by mass or more, the friction coefficient for rubber may be readily reduced, and when the content ratio is 3% by mass or less, the oxidation stability can be prevented from worsening.

The ratio by mass of the polyalcohol ester of the component (D) to the zinc dithiophosphate of the component (B) ([content of polyalcohol ester of component (D)]/[content of zinc dithiophosphate of component (B)]) in the lubricating oil composition for a shock absorber is, from the viewpoint of reducing the friction coefficient, preferably from 0.1 to 3, more preferably from 0.5 to 1.5.

[Optional Additive Component]

The shock absorber oil of the present invention can suitably contain, as an optional additive component (E), at least one selected from ash-less detergent-dispersants, metal-based detergents, lubricity improvers, antioxidants, rust preventive agents, metal deactivators, viscosity index improvers, pour-point depressants and antifoaming agents, within a range not detracting from the object of the present invention.

The content ratio of the optional additive component (E) in the total amount of the lubricating oil composition for a shock absorber is, in general, preferably 10% by mass or less, more preferably from 0.1 to 7% by mass.

Examples of the ash-less detergent-dispersant include succinimides, boron-containing succinimides, benzylamines, boron-containing benzylamines, bivalent carboxylic amides typified by those with succinic acid. Examples of the metal-based detergent include neutral metal sulfonates, neutral metal phenates, neutral metal salicylates, neutral metal phosphonates, basic sulfonates, basic phenates, basic salicylates, over-based sulfonates, over-based salicylates, over-based phosphonates, etc.

As the lubricity improvers, extreme pressure agents, antifriction agents, and oiliness agents are mentioned. For example, there are mentioned phosphorus-containing ester compounds such as phosphates, amine salts of acidic phosphoric monoesters, acidic phosphorous diesters, etc.; organic metal compounds such as zinc dithiocarbamate (ZnDTC), oxymolybdenum organo-phosphorodithioate sulfide (MoDTP), oxymolybdenum dithiocarbamate sulfide (MoDTC), etc.

Moreover, sulfur-based extreme pressure agents such as sulfurized oils, sulfurized fatty acids, sulfurized esters, sulfurized olefins, dihydrocarbyl polysulfides, thiadiazole compounds, alkylthiocarbamoyl compounds, triazine compounds, thioterpene compounds, dialkyl thiodipropionate compounds and the like are mentioned.

In addition, examples of the oiliness agent include aliphatic saturated and unsaturated monocarboxylic acids such as stearic acid, oleic acid, etc.; polymerized fatty acids such as dimer acid, hydrogenated dimer acid, etc.; hydroxy fatty acids such as ricinoleic acid, 12-hydroxystearic acid, etc.; aliphatic saturated and unsaturated monohydric alcohols such as lauryl alcohol, oleyl alcohol, etc.; aliphatic saturated and unsaturated monoamines such as stearyl amine, oleylamine, etc.; aliphatic saturated and unsaturated monocarboxylic acid amides such as lauric acid amide, oleic acid amide, etc.

Examples of the antioxidant include polycyclic phenolic antioxidants such as 4,4'-methylenebis(2,6-di-tert-butylphenyl), 2,2'-methylenebis(4-ethyl-6-tert-butylphenol), etc.; amine-based antioxidants including monoalkyldiphenylamines compounds such as monooctyldiphenylamine, monononyldiphenylamine, etc., dialkyldiphenylamines compounds such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine, 4,4'-dinonyldiphenylamine, etc., polyalkyldiphenylamines compounds such as tetrabutyldiphenylamine, tetrahexyldiphenylamine, tetraoctyldiphenylamine, tetranonyldiphenylamine, etc., and naphthylamine compounds such as α-naphthylamine, phenyl-α-naphthylamine, butylphenyl-α-naphthylamine, pentylphenyl-α-naphthylamine, hexylphenyl-α-naphthylamine, heptylphenyl-α-naphthylamine, octylphenyl-α-naphthylamine, nonylphenyl-α-naphthylamine, etc.; and sulfur-containing antioxidants such as 2,6-di-tert-butyl-4-(4,6-bis(octylthio)-1,3,5-triazin-2-ylamino)phenol, thioterpene compounds including a reaction product of phosphorus pentasulfide and pinene, etc., dialkyl thiodipropionates including dilauroylthio dipropionate, distearyl thiodipropionate, etc.

Examples of the rust preventive agent include metal sulfonates, succinates, etc. Examples of the metal deactivator include benzotriazole, thiadiazole, etc.

Examples of the viscosity index improver include polymethacrylate, dispersive polymethacrylate, olefinic copolymer (for example, ethylene-propylene copolymer, etc.), dispersive olefinic copolymer, styrenic copolymer (for example, styrene-diene hydrogenated copolymer, etc.), etc.

Examples of the pour-point depressant include polymethacrylate having a weight-average molecular weight of from 50,000 to 150,000 or so, etc.

As the antifoaming agents, preferred are high-molecular-weight silicone antifoaming agents. By incorporating the high-molecular-weight silicone antifoaming agent, the antifoaming ability is effectively demonstrated and the riding comfort is improved. As the high-molecular-weight silicone antifoaming agents, for example, organopolysiloxane can be mentioned, and fluorine-containing organopolysiloxanes such as trifluoropropylmethyl silicone oil are particularly preferable.

The kinematic viscosity at 40° C. of the lubricating oil composition for a shock absorber of the present invention is, from the viewpoint of low-temperature flowability, preferably from 2 to 45 $mm^2/s$ or less, more preferably from 10 to 40 $mm^2/s$.

In the lubricating oil composition for a shock absorber of the present invention, the amount of phosphorus not bonding to the sulfur atom is, from the viewpoint of thermal stability, preferably 1% by mass or less relative to the total amount of the lubricating oil composition, more preferably 0.1% by mass or less.

The lubricating oil composition for a shock absorber of the present invention is excellent in thermal stability and does not degrade through oxidation at high temperatures and, in addition, it can reduce the friction coefficient for rubber and therefore does not detract from the riding comfort at the time when the expansion and contraction movement of a shock absorber is small.

The lubricating oil composition for a shock absorber of the present invention can be used in any of a multi-cylinder shock absorber and a single-cylinder shock absorber, and can be favorably used in any shock absorbers for cars and motorcycles, but is especially favorably used for motorcycles.

<Friction Reduction Method for Shock Absorber>

The friction reduction method for a shock absorber of the present invention includes adding the above-mentioned lubricating oil composition for a shock absorber of the present invention, to a shock absorber.

Examples of the shock absorber include a multi-cylinder shock absorber and a single-cylinder shock absorber. The friction reduction method of the present invention exhibits a comprehensive effect to all these shock absorbers, but exhibits an especially excellent effect in the case where rubber friction may occur inside a shock absorber (for example, in the case where the sealant and/or the bush are formed of rubber). In addition, the friction reduction method of the present invention is effective for reducing friction in any shock absorbers for cars and motorcycles, but is especially effective for reducing friction in a shock absorber for motorcycles.

EXAMPLES

Next, the present invention is described in more detail by Examples, but the present invention is not whatsoever restricted by these Examples.

Measurement of the friction coefficient and the thermal stability test were carried out according to the following methods.

1. Measurement of Rubber Friction Coefficient

Tester: Bowden Type Reciprocating Friction Tester

Test Conditions

Load; 1.0 kgf

Amplitude: 10 mm

Rate: 0.2 mm/s

Temperature: 60° C.

Number of Friction: 1

Friction Material:

Upper rubber (A727, manufactured by NOK Corporation)

Lower chrome-plated plate (50×1,000×5 mm)

For the rubber part, a rubber plate was cut into a disc having a diameter of 15 mm, and as in FIG. 1, this was pushed with a ball having a diameter of 12.7 mm. A few drops of a sample oil were put onto the plate, running-in operation (at a rate of 8 mm/s, and under a load of 0.1 kgf for 2 minutes, a load of 0.2 kgf for 2 minutes, a load of 0.3 kgf for 2 minutes and a load of 0.5 kgf for 2 minutes) was performed, and then the test was performed under the conditions mentioned above.

2. Thermal Stability 2-1. Sludge Amount (Millipore Value)

In a heat-resistant glass container having a capacity of 200 mL, a lubricating oil composition for a shock absorber, an iron catalyst and a copper catalyst were put and sealed up, and under the condition of an atmospheric pressure and a temperature of 120° C., these were kept for 48 hours. The formed sludge amount (millipore value) was measured. The unit is mg/100 cc.

2-2. Observation of Outward Appearance of Iron Catalyst

In a heat-resistant glass container having a capacity of 200 mL, a lubricating oil composition for a shock absorber and an iron catalyst were put and sealed up, and under the condition of an atmospheric pressure and a temperature of 120° C., these were kept for 48 hours. The degree of discoloration of the iron catalyst was visually checked.

2-3. Observation of Outward Appearance of Oil

In a heat-resistant glass container having a capacity of 200 mL, a lubricating oil composition for a shock absorber, an iron catalyst and a copper catalyst were put and sealed up, and under the condition of an atmospheric pressure and a temperature of 120° C., these were kept for 48 hours. The color of the lubricating oil composition for a shock absorber was visually checked.

Examples 1 to 2 and Comparative Examples 1 to 5

Lubricating oil compositions for a shock absorber containing the components shown in Table 1 were prepared, and these were tested for the friction coefficient and tested in the thermal stability. The results are shown in Table 1. In the lubricating oil compositions for a shock absorber of Examples 1 and 2, the amount of phosphorus not bonding to the sulfur atom is not more than 0.1% by mass relative to the total amount of the lubricating oil composition.

TABLE 1

| | | Example 1 | Example 2 | Comparative Example 1 | Comparative Example 2 | Comparative Example 3 | Comparative Example 4 | Comparative Example 5 |
|---|---|---|---|---|---|---|---|---|
| Lubricating Oil Composition | (A) Base Oil 1 | 93.699 | 93.699 | 93.699 | 93.699 | 94.199 | 93.699 | 93.999 |
| | (B) Zinc Dithio-phosphate 1 | 0.500 | — | — | — | — | — | 0.500 |
| | (B) Zinc | — | 0.500 | — | — | — | — | — |

TABLE 1-continued

| | | Example 1 | Example 2 | Comparative Example 1 | Comparative Example 2 | Comparative Example 3 | Comparative Example 4 | Comparative Example 5 |
|---|---|---|---|---|---|---|---|---|
| | Dithio-phosphate 2 Zinc | — | — | — | 0.500 | — | — | — |
| | Dithio-phosphate 3 | | | | | | | |
| | Dioleyl Acid Phosphate | — | — | 0.500 | — | — | — | — |
| | Distearyl Acid Phosphate | — | — | — | — | — | 0.500 | — |
| | (C) Fatty Acid Amide | 0.300 | 0.300 | 0.300 | 0.300 | 0.300 | 0.300 | — |
| | (D) Polyalcohol Ester | 0.500 | 0.500 | 0.500 | 0.500 | 0.500 | 0.500 | 0.500 |
| | Viscosity Index Improver | 5.000 | 5.000 | 5.000 | 5.000 | 5.000 | 5.000 | 5.000 |
| | Antifoaming Agent | 0.001 | 0.001 | 0.001 | 0.001 | 0.001 | 0.001 | 0.001 |
| 40° C. Kinematic Viscosity ($mm^2/s$) | | 35.0 | 34.9 | 35.2 | 35.0 | 34.7 | 35.5 | 34.8 |
| Friction Coefficient | | 0.14 | 0.13 | 0.07 | 0.31 | 0.28 | 0.43 | 0.25 |
| Thermal Stability Test | Millipore Value (mg/100 cc) | 0 | 0 | 63 | 0 | 0 | 4.9 | 5 |
| | Iron Catalyst | No discoloration | No discoloration | Geat discoloration | No discoloration | No discoloration | No discoloration | No discoloration |
| | Oil Appearance | Pale yellow | Pale yellow | Black | Transparent | Pale yellow | Brown | Pale yellow |

[Notes]

1) Base oil 1: This was prepared by mixing the mineral oil 1 having a 40° C. kinematic viscosity of 9.412 $mm^2/s$ and a 15° C. density of 0.8911 $g/cm^3$, and the mineral oil 2 having a 40° C. kinematic viscosity of 34.49 $mm^2/s$ and a 15° C. density of 0.8640 $g/cm^3$ in a ratio of mineral oil 1/mineral oil 2 = 25/74.5, and the 40° C. kinematic viscosity of the resultant base oil was 23.2 $mm^2/s$.

2) Zinc dithiophosphate 1: zinc salt of dilauryl dithiophosphate

3) Zinc dithiophosphate 2: zinc salt of dioleyl dithiophosphate

4) Zinc dithiophosphate 3: zinc dialkylthiophosphate (alkyl group = mixed alkyl group with from 3 to 6 carbon atoms)

5) Fatty acid amide: reaction product of isostearic acid and tetraethylenepentamine 6) Polyalcohol ester: dioleyl ester of pentaerythritol, molecular weight: 665.1

7) Viscosity index improver: polymethyl methacrylate having a weight-average molecular weight of 61,000.

8) Antifoaming agent: fluorine-containing organopolysiloxane

As obvious from the results in Table 1, it is known that the lubricating oil compositions for shock absorbers of Examples 1 to 2 satisfy both thermal stability and reduction in the friction coefficient for rubber.

On the other hand, the lubricating oil compositions of Comparative Example 1 and Comparative Example 4 were poor in thermal stability owing to the influence of the phosphorus compound (dioleyl acid phosphate, distearyl acid phosphate) thereon. The lubricating oil composition of Comparative Example 2 could not reduce the friction coefficient for rubber since the carbon number of the alkyl group in the zinc dithiophosphate was from 3 to 6. The lubricating oil composition of Comparative Example 3 did not contain a zinc dithiophosphate, and therefore could not reduce the friction coefficient for rubber. The lubricating oil composition of Comparative Example 5 did not contain a fatty acid amide, and therefore could not reduce the friction coefficient for rubber.

INDUSTRIAL APPLICABILITY

The lubricating oil composition for a shock absorber of the present invention can be used in any of a multi-cylinder shock absorber and a single-cylinder shock absorber, and can be used in any shock absorbers for cars and motorcycles, but is especially favorably used for motorcycles.

The invention claimed is:

1. A lubricating oil composition, consisting of:

(A) at least one base oil comprising a mineral oil and/or a synthetic oil;

(B) at least one zinc dithiophosphate represented by formula (I):

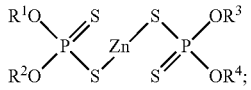

(I)

(C) at least one fatty acid amide;

(D) at least one polyalcohol ester;

(E) optionally at least one ashless detergent dispersant;

(F) optionally at least one lubricity improver;

(G) optionally at least one sulfur-based extreme pressure agent;

(H) optionally at least one oiliness agent;

(I) optionally at least one antioxidant;

(J) optionally at least one rust preventative agent;

(K) optionally at least one viscosity index improver;

(L) optionally at least one pour point depressant; and (M) optionally at least one antifoaming agent, wherein:

$R^1$ to $R^4$ each independently represent at least one selected from a linear, branched or cyclic alkyl group having from 10 to 20 carbon atoms and a linear, branched or cyclic alkenyl group having from 10 to 20 carbon atoms; and the at least one polyalcohol ester (D) is an ester of a trihydric or more polyhydric polyalcohol and a linear or branched fatty acid having from 12 to 24 carbon atoms or a mixed fatty acid thereof.

2. The lubricating oil composition according to claim 1, wherein $R^1$ to $R^4$ are each independently at least one selected from a linear, branched or cyclic alkyl group having from 10 to 18 carbon atoms and a linear, branched or cyclic alkenyl group having from 10 to 18 carbon atoms.

3. The lubricating oil composition according to claim 1, comprising from 0.01 to 3% by mass of the zinc dithiophosphate (B) based on a total amount of the lubricating oil composition.

4. The lubricating oil composition according to claim 1, wherein a carbon number of a carboxylic acid constituting the fatty acid amide of the component (C) is from 8 to 24.

5. The lubricating oil composition according to claim 1, comprising from 0.01 to 3% by mass of the fatty acid amide (C) based on a total amount of the lubricating oil composition.

6. The lubricating oil composition according to claim 1, wherein a ratio by mass of the fatty acid amide (C) to the zinc dithiophosphate (B) ([content of fatty acid amide of component (C)]/[content of zinc dithiophosphate of component (B)]) in the lubricating oil composition is from 0.1 to 2.

7. The lubricating oil composition according to claim 1, wherein the polyalcohol ester (D) is an ester of pentaerythritol.

8. The lubricating oil composition according to claim 1, comprising from 0.01 to 3% by mass of the polyalcohol ester (D) based on a total amount of the lubricating oil composition.

9. The lubricating oil composition according to claim 1, wherein a ratio by mass of the polyalcohol (D) to the zinc dithiophosphate (B) ([(content of polyalcohol of component (D)]/[content of zinc dithiophosphate of component (B)]) in the lubricating oil composition is from 0.1 to 3.

10. The lubricating oil composition according to claim 1, which has a kinematic viscosity at 40° C. of from 2 to 45 $mm^2/s$.

11. The lubricating oil composition according to claim 1, which is adapted to function as a lubricating oil for a motorcycle.

12. A method for reducing friction in a shock absorber, the method comprising adding the lubricating oil composition of claim 1 to a shock absorber.

13. A lubricating oil composition, consisting of:

(A) at least one base oil comprising a mineral oil and/or a synthetic oil;

(B) at least one zinc dithiophosphate represented by formula (I):

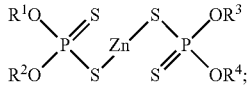

(I)

(C) at least one fatty acid amide; and (D) at least one polyalcohol ester;

(E) optionally at least one ashless detergent dispersant;

(F) optionally at least one lubricity improver;

(G) optionally at least one sulfur-based extreme pressure agent;

(H) optionally at least one oiliness agent;

(I) optionally at least one antioxidant;

(J) optionally at least one rust preventative agent;

(K) optionally at least one viscosity index improver;

(L) optionally at least one pour point depressant; and (M) optionally at least one antifoaming agent, wherein:

$R^1$ to $R^4$ each independently represent at least one selected from a linear, branched or cyclic alkyl group having from 6 to 20 carbon atoms and a linear, branched or cyclic alkenyl group having from 6 to 20 carbon atoms; and the at least one polyalcohol ester (D) is not formed from an aliphatic dibasic acid.

* * * * *